US005158583A

United States Patent [19]

Bodin et al.

[11] Patent Number: 5,158,583

[45] Date of Patent: Oct. 27, 1992

[54] INSTALLATION FOR THE REMOTE CLEANING BY DEGRADATION OF A SURFACE IN A HOSTILE MEDIUM WITH WASTE RECOVERY AND TREATMENT

[75] Inventors: Francois Bodin, Equeurdrëville; Jean Bonnant, Cherbourg, both of France

[73] Assignee: Cogema-Compagnie General Des Matieres Nucleaires, Cedex, France

[21] Appl. No.: 699,961

[22] Filed: May 14, 1991

[30] Foreign Application Priority Data

May 15, 1990 [FR] France ..... 90 06040

[51] Int. Cl.[5] ..... B03C 3/01

[52] U.S. Cl. ..... 55/126; 55/257.1; 55/274; 55/345; 55/350; 55/385.5

[58] Field of Search ..... 55/126, 259, 345, 350, 55/315, 385.2, 385.5, 385.7, 257.1, 257.4, 274

[56] References Cited

U.S. PATENT DOCUMENTS

| | | | |
|---|---|---|---|
| 2,064,495 | 12/1936 | Queneau | 55/126 X |
| 3,418,788 | 12/1968 | Sugimoto | 55/385.5 X |
| 3,581,469 | 6/1971 | Davis et al. | 55/126 |
| 4,055,331 | 10/1977 | Hegemann | 55/385.5 X |
| 4,406,330 | 9/1983 | Jysky | 55/385.5 X |
| 4,526,311 | 7/1985 | Schroder | 228/119 |
| 4,576,613 | 3/1986 | Miline | 55/385.5 X |
| 4,623,294 | 11/1986 | Schroeder | 414/590 |
| 4,865,629 | 9/1989 | Zievers et al. | 55/345 X |

FOREIGN PATENT DOCUMENTS

| | | | |
|---|---|---|---|
| 1127980 | 7/1982 | Canada | 55/126 |
| 3700814 | 7/1988 | European Pat. Off. . | |
| 2538604 | 12/1982 | France . | |

*Primary Examiner*—Richard L. Chiesa
*Attorney, Agent, or Firm*—Pearne, Gordon, McCoy & Granger

[57] ABSTRACT

In order to clean a surface (A) located in a hostile medium, use is made of a bush hammer (34) mounted on a remotely controlled vehicle (32). The waste produced by the bush hammer (34) is directly collected by a collecting pipe (12) connected to an exhauster (14). Cyclone separators (22, 24), an electostatic filter (26) and absolute filters (28, 30) arranged in this order on the collecting pipe recover the waste in decreasing size order. The cyclone separators are mounted on two compartments (76, 78) formed in a vessel (80) and each equipped with devices (90, 92, 100, 102, 106, 108) making it possible to inject into the compartments a waste treatment product and to recover the same after filtering. A container (120) is also placed beneath the electrostatic filter (26).

11 Claims, 2 Drawing Sheets

INSTALLATION FOR THE REMOTE CLEANING BY DEGRADATION OF A SURFACE IN A HOSTILE MEDIUM WITH WASTE RECOVERY AND TREATMENT

The invention relates to an installation making it possible to clean a surface located in a hostile medium, such as a surface in a highly irradiating cell in the nuclear industry, by a remotely controlled degradation of said surface. The installation also has means making it possible to recover and treat the waste produced by said degradation process.

BACKGROUND OF THE INVENTION

Hitherto, in the nuclear industry, the cleaning of an irradiating contaminated cell could only be carried out by the direct intervention within the cell of a large number of people directly carrying out the degradation of the surface to be cleaned. However, this solution is not available when the highly irradiating state and the very high degree of contamination of a cell prevents any direct human intervention therein. Moreover, even when human interventions within the cell are not entirely impossible, they lead to the personnel absorbing significant dosage levels which should be avoided. Moreover, such interventions makes it necessary to store the waste material produced by the degradation of the surface in intermediate receptacles placed within the cell, before the said waste material can be treated and stored in a definitive manner.

The present invention specifically relates to an installation, whose original design makes it possible to carry out both the remote cleaning by degradation of a surface in a hostile medium and the automatic recovery and treatment of the waste produced by said degradation, which makes it possible to allow intervention in all cases, no matter what the degree of contamination of a cell, without any human intervention other than that required by the punctual maintenance of the installation and the means incorporated into the latter. In addition, said installation makes it possible to directly treat and store the waste without passage into intermediate receptacles.

SUMMARY OF THE INVENTION

According to the invention, this result is achieved by means of an installation for the remote cleaning by degradation of a surface located in a hostile medium with recovery and treatment of the waste produced by the degradation, comprising:

- a remotely controlled vehicle carrying at least one bush hammering means having at least one cutting edge which can be given a reciprocating movement by actuating means, in order to strike the said surface within a closed space peripherally defined by a casing of the bush hammering means;
- a pipe for collecting the waste produced by the cutting edges within the said closed space, connected to the casing and whose opposite end is connected to exhauster means;
- at least one cyclone separator and filtering means placed successively in this order on the collecting pipe;
- at least one tightly closed vessel for receiving and treating the waste collected by the cyclone separator and disconnectably connected below the latter and internally equipped with treatment product injection means and means for the recovery of said products through filters.

According to a preferred embodiment of the invention, said installation comprises a single tightly closed vessel within which are formed a first relatively large volume compartment connected beneath a first cyclone separator and a second relatively small volume compartment connected beneath a second cyclone separator positioned downstream of the first cyclone separator on the collecting pipe, the first and second compartments being internally equipped with means for injecting treatment products and means for recovering said products through filters.

Advantageously, the filtering means then have, downstream of the cyclone separator on the collecting pipe, an electrostatic filter having a hopper bottom, which can be connected tightly to a container, which recovers the dust, following the electrical stoppage of the electrostatic filter.

Deflectors placed in the inlet cone of the electrostatic filter then make it possible to homogeneously distribute the air flow within the said filter, whilst the flow of dust towards the container can be improved by placing a vibrator on the hopper bottom of the electrostatic filter.

In order to complete the filtering of the air prior to its discharge to the outside, at least one absolute filtering member is placed downstream of the electrostatic filter.

The installation is preferably automated by equipping the electrostatic filter and each of the absolute filtering members with clogging detectors making it possible to successively control the automatic stoppage of the actuating means for the cutting edge of the bush hammering means and the automatic stopping of the exhauster means when clogging is detected.

DESCRIPTION OF THE PREFERRED EMBODIMENT

Figure 1:
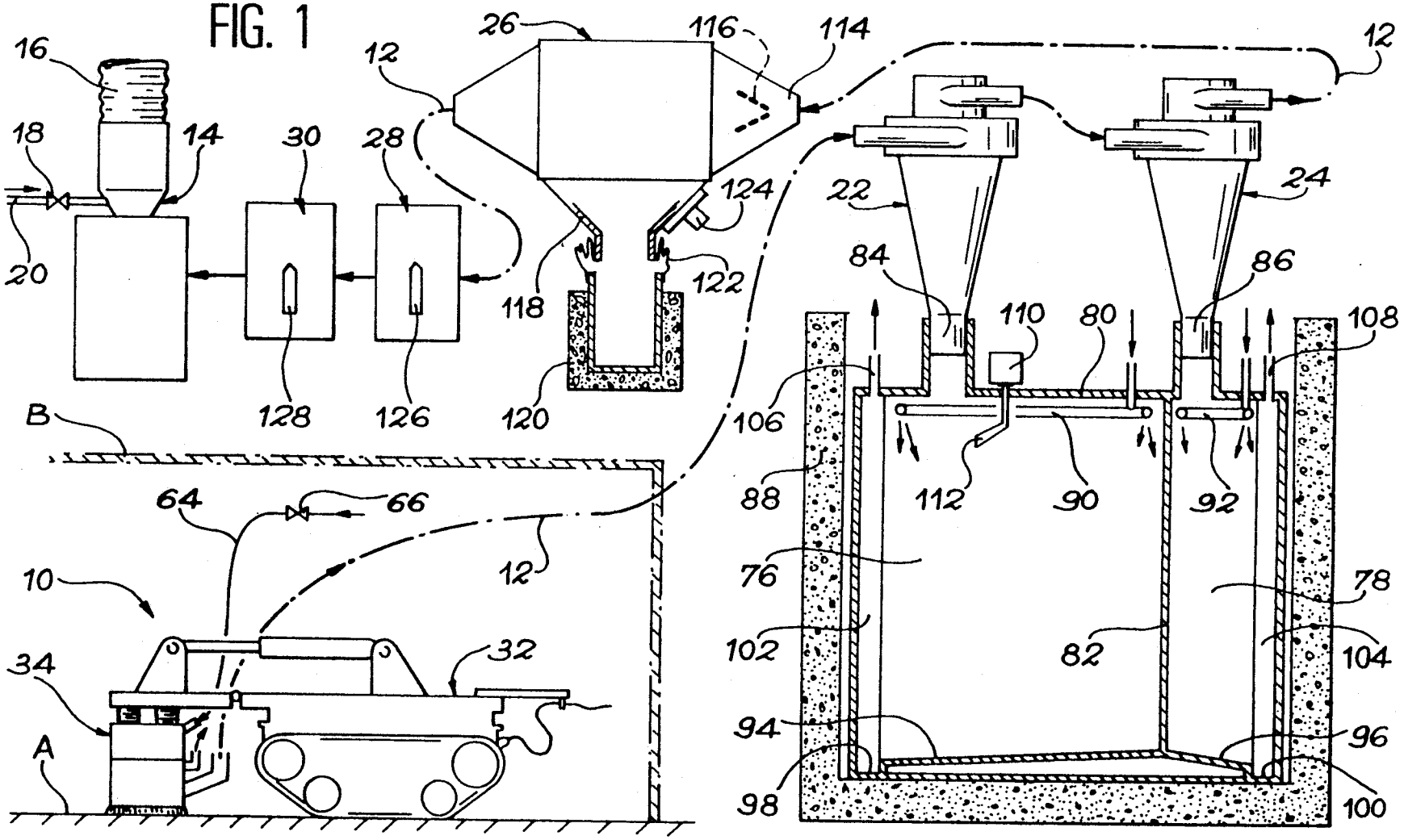
FIG. 1—A part sectional view diagrammatically showing a remote cleaning installation according to the invention.

The embodiment illustrated in the drawings relates to the cleaning of the contaminated degradable surface A of the floor of a highly irradiating, contaminated cell B. However, this application must not be considered as limitative and the installation according to the invention can be used for cleaning by degradation a surface having a random orientation (floor, wall, roof, ceiling, etc.) in a hostile medium, which can either be a confined cell used in the nuclear industry or a random zone in which the intervention time for human beings is very limited or even zero.

The nature of the material forming the surface to be cleaned can be of a random type, provided that said surface can be degraded by a bush hammering means. This surface can in particular be formed on a concrete or equivalent material wall which may or may not be painted.

The remote cleaning installation according to the invention comprises a remotely controlled bush hammering assembly 10 placed in the hostile zone to be cleaned, i.e. within the cell B in the embodiment shown. A pipe 12 for collecting the waste produced by the remotely controlled bush hammering assembly 10 connects the latter to the remainder of the installation located outside the hostile zone, i e. outside the cell B in FIG. 1.

The end of this waste collecting pipe 12 opposite to the remotely controlled bush hammering assembly 10 is connected to an exhauster means 14 which forces air outside by a discharge sheath 16. In the embodiment illustrated in the drawings, the exhauster means 14 is a pneumatic ejector operating on the basis of the venturi effect when an electrovalve 18 placed in a compressed air supply duct 20 is opened.

Outside the cell B, the waste collecting pipe 12 successively traverses a first cyclone separator 22, a second cyclone separator 24, an electrostatic filter 26 and two nuclear quality, absolute filters 28 and 30 before reaching the exhauster means 14. These different equipments make it possible to successively extract from the air sucked in by the pipe 12 waste material (screenings and dust), whose size gradually decreases in such a way that the air discharged by the sheath 16 is sufficiently clean to be directly discharged into the atmosphere.

The structure of the remotely controlled bush hammering assembly 10 will now be described in greater detail relative to FIG. 2. This assembly 10 essentially comprises a remotely controlled vehicle 32 and a bush hammering means 34 supported by the said vehicle. It should be noted that in certain special cases, the remotely controlled vehicle can simultaneously carry several bush hammering means.

The remotely controlled vehicle 32 can be of a random type adapted to the nature of the terrain in the zone where an intervention is necessary. It can in particular be a caterpillar vehicle as in the drawing, or can be a vehicle having wheels or feet.

The vehicle 32 can be entirely radio controlled, without any mechanical connection by cable or pipe connecting it to the not shown remote control means located outside the hostile zone and with the aid of which an operator, in all safety, controls the movements of the vehicle, the application of the bush hammering means 34 to the surface A to be cleaned and the actuation of said means. In the embodiment shown in FIG. 2, the transmission to the vehicle 32 of control signals ensuring the displacements of the latter and the application of the bush hammering means to the surface to be treated is effected by means of an assembly 36 of cables and pipes located on a bracket 38 articulated to the rear of the remotely controlled vehicle 32. The bracket 38 is oriented horizontally and pivots about a vertical axis when the surface A is horizontal. When the vehicle moves rearwards, said bracket 38 can be oriented to the right or left of the vehicle in order that the assembly 36 of cables and pipes is moved out of the vehicle travel area.

Figure 2:
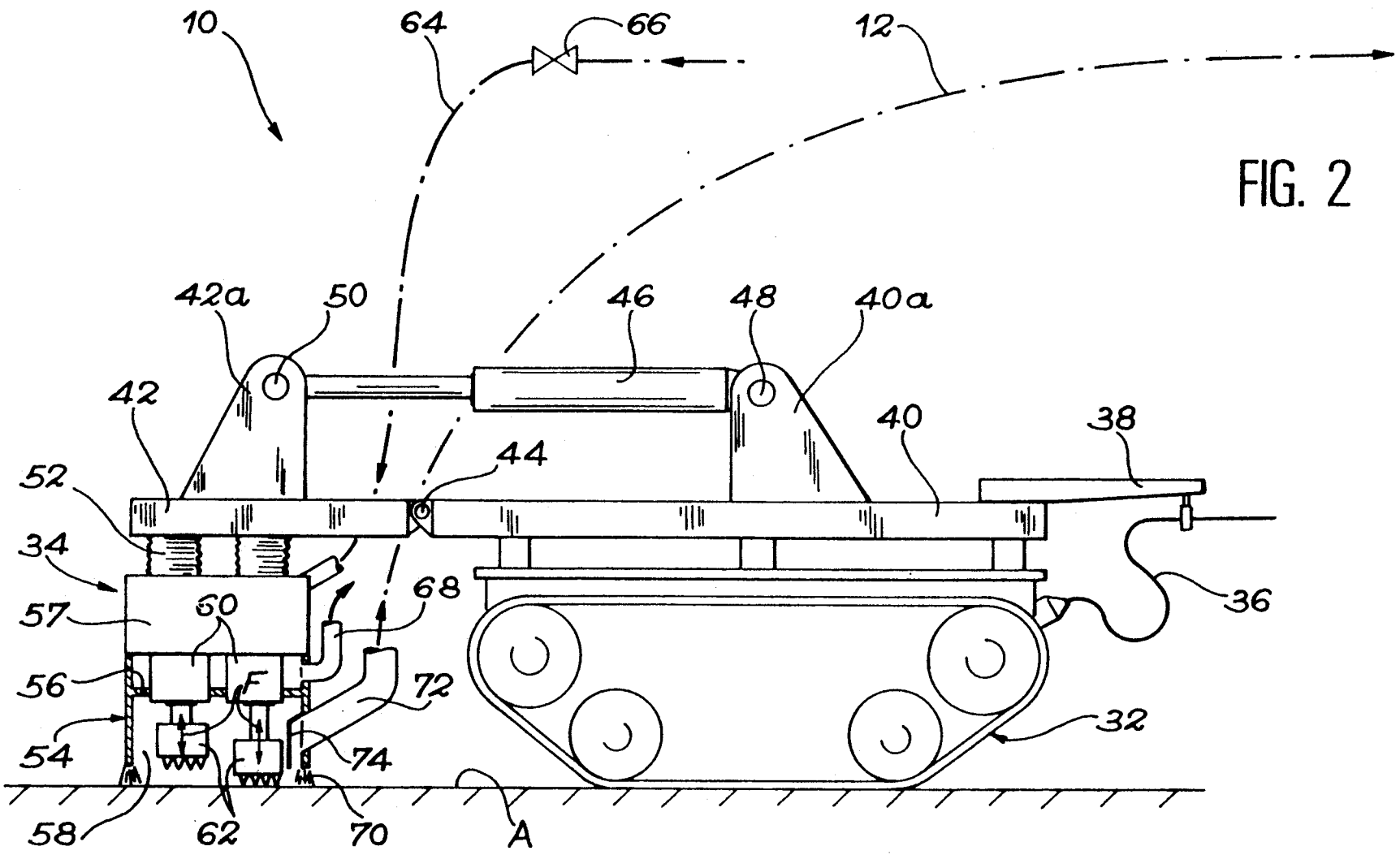
FIG. 2—A view showing on a larger scale that part of the installation illustrated in FIG. 1 located in the hostile zone in which cleaning is to take place.

In the embodiment illustrated in FIG. 2, the remotely controlled vehicle 32 has an upper support plate 40 on which are respectively articulated the bracket 38 at the rear of the vehicle and a plate member 42 supporting the bush hammering means 34 at the front of the vehicle. More specifically, the plate member 42 is articulated to the support plate 40 by a shaft 44 oriented transversely with respect to the vehicle 32 and in a horizontal direction when the said vehicle rests on a horizontal surface A.

One or more jacks 46 such as pneumatic or electric jacks are articulated by their ends respectively to a member **40*a* integral with the upper face of the support plate 40 and a member 42*a* integral with the upper face of the plate member 42. The corresponding pivot pins are designated 48 and 50** in FIG. 2.

Under normal operating conditions, as illustrated in FIG. 2, the jacks 46 are in the elongated position and the plate member 42 is substantially located in the extension of the support plate 40. However, when a displacement of the vehicle 32 is envisaged, the jacks 46 are actuated in the sense of reducing their length in order to free the bush hammering means 34 from the ground. Obviously, this configuration corresponding to the cleaning of the ground or floor of the area in question, can be modified at random when the surfaces to be treated are oriented differently, e.g. in a vertical or downwardly turned direction.

As illustrated in FIG. 2, the bush hammering means 34 is mounted on the lower face of the plate member 42 by shock absorbers 52 making it possible to reduce the transmission to the vehicle 32 of vibrations produced by the means 34.

The bush hammering means 34 has a casing 54 internally defining, on either side of a horizontally oriented partition 56 when the bush hammering means is engaged against a horizontal surface A, an upper control zone 57 and a lower closed space 58. The upper control zone contains one or more, preferably pneumatically controlled, motors 60, which displace with a linear, reciprocating movement oriented perpendicular to the partition 56, one or more cutting edges 62 located in the chamber 58. The face of each of the cutting edges 62 opposite to the partition 56 has steeled teeth making it possible to degrade the surface A to which the bush hammering means 34 is applied, when the cutting edges 62 strike said surface under the effect of their reciprocating movements illustrated by the arrows F in FIG. 2.

The actuation of the motors 60 is controlled by a compressed air supply pipe 64 controlled by an electrovalve 66. Like the assembly 36 of cables and pipes, the pipe 64 is connected to not shown control means located outside the cell. The air leaving the motors 60 in the upper control zone 57 is directly expelled into the cell by a discharge pipe 68 connected to the casing 54. The cross-section of the said pipe 68 is at least twice that of the compressed air supply pipe 64.

Below the partition 56 the casing 54 is extended around the cutting edges 62 up to the annular terminal edge carrying a strip or brush 70, which can be tightly applied to the surface A to be treated, under the effect of the vacuum created in the chamber 58 by the exhauster means 14. Under these conditions, the travels of the motors 60 controlling the linear, reciprocating movement of the cutting edges 62 are such that the latter are spaced from the surface A when they occupy their retracted positions. However, the lower face of each of the cutting edges 62 can strike the surface A when the said edges are moved towards the said surface by the motors 60.

During the confinement of the bush hammering means 34, the dynamic confinement of the chamber 58 is ensured by the vacuum created in the waste collecting pipe 12 by the exhauster means 49. Thus, the distance between the partition 56 and the surface A to be treated is substantially constant when the bush hammering means is in the working position.

In order to permit the collection of the waste produced by the action of the cutting edges 62 on the surface A, the pipe 12 is connected to a tube 72, which traverses the rear edge of the casing 54 of the means 34 and issues into the chamber 58. A deflector 74 is located in the said chamber facing the end of the tube 72, so that the latter issues in the immediate vicinity of the surface A and over the entire width of the bush hammering means by a reduced width passage. The pressure drop created in this way makes it possible to suck in, to the rear of the bush hammering means and over its entire width, particles and larger waste matter than the dust produced by the striking of the cutting edges 62 on the surface.

On referring once again to FIG. 1, it is possible to see that the two cyclone separators 22, 24 arranged successively in the waste collecting pipe 12 outside the cell B are positioned above two tightly closed compartments 76, 78 defined in a tightly closed reception and treatment vessel 80 by a vertical partition 82. More specifically, the cyclone separators 22, 24 are tightly connected by quick-action couplings 84, 86 to inlets formed in the upper wall of the vessel 80 on either side of the partition 82 and vertically with respect to the compartments 76, 78 respectively. In order to take account of the size difference of the particles which can be respectively received in the compartments 76 and 78, the volume of the compartment 76 is approximately 15 to 20 times larger than that of the compartment 78. The vessel 80 is placed in a concrete container 88, which has no cover and which ensures the biological protection.

Each of the compartments 76, 78 of the vessel 80 receives in its upper part a row of sprinklers 90, 92, which can be connected to an appropriate, but not shown circuit making it possible to inject into the corresponding compartment a product which treats the waste received therein. As a function of the particular case, the treatment can be carried out in a single operation at the end of the filling of the compartments 76 and 78, or at different stages during the said filling.

The bottom 94, 96 of each of the compartments 76, 78 is inclined towards a bottom point 98, 100 thereof, above which is placed a filter 102, 104 advantageously separated from the remainder of the compartment by a not shown partition. A pipe 106, 108 install=d on the upper wall of the vessel 80 above each of the filters 102, 104 makes it possible, when it is connected to an adequate exhausting or suction circuit, to recover the treatment product injected by the rows of sprinklers 90, 92, in the case of a liquid, after the latter has traversed the waste contained in the compartments 76 and 78 and then the filters 102, 104.

Above the compartment 76, the vessel 80 is advantageously equipped with a level detector 110 having a rotary blade 112 installed on the upper wall of the vessel 80. When the level detector 110 associated with the vessel 80 detects the filling of the compartment 76 by the stopping of the rotation of its blade 112, the operation of the remotely controlled bush hammering assembly 10 is stopped, as is that of the exhauster means 14. The cyclone separators 22, 24 are then withdrawn by the disconnection of the quick-action couplings 84, 86. The thus freed openings in the upper wall of the vessel 80 make it possible to introduce into each of the compartments 76, 78 concrete or some other material for blocking the screenings contained therein. The rows of sprinklers 90, 92, as well as the pipes 106, 108 are then dismantled and the upper part of the vessel 80 is concreted so as to form a cover sealing the container 88 in such a way as to ensure its mechanical and biological continuity.

The screenings and dust not recovered in the two compartments 76, 78 of the vessel 80 are supplied to the electrostatic filter 26 by the waste collecting pipe 12. The inlet cone 114 of the electrostatic filter 26 is equipped with deflectors 116 ensuring a homogeneous distribution of the dust in the air stream traversing the diffusers and then the ionizers of the electrostatic filter. The latter is equipped in its lower part with a hopper bottom 118, whose lower end is tightly connected to a container 120 by a weldable sleeve 122. A vibrator 124 is mounted on the hopper bottom 118.

When the electrostatic filter 26 is electrically supplied, the dust trapped within the latter remains fixed thereto. However, when the electrical supply to the filter 26 is cut off, the dust trapped in the latter drops by gravity into the container 120, where it is guided by the hopper bottom 118. In order to improve the dropping of the dust, the vibrator 124 is then put into action.

Not shown means are associated with the electrostatic filter 26 in order to detect the blockage or clogging thereof. When this detection takes place, the remotely controlled bush hammering assembly 10 is stopped, as is the exhauster means 14. After stopping the electric supply to the electrostatic filter 26 and operating the vibrator 124, the dust drops into the container 120 in the manner described hereinbefore.

Another not shown means detects the filling of the container 120. When this detection takes place, the complete installation is stopped and the container 120 is removed and separated from the electrostatic filter 26 by extending and welding closed the sleeve 122. The biological protection of the container 120 is then completed by the addition of a cover to its upper part.

The dust still remaining in the air leaving the electrostatic filter 26 is conveyed by the pipe 12 to the absolute filters 28 and 30. The clean air leaving these filters is discharged to the outside through the sheath 16 by the exhauster means 14. Each of the absolute filters 28, 30 is advantageously equipped with a manostat 126, 128 making it possible to detect the clogging thereof when it is energized.

The complete installation described hereinbefore is remotely controlled and its different components are interlinked. In particular, the putting into operation of the exhauster means 14, controlled by the opening of the electrovalve 18, can only take place if the electrostatic filter 26 is live and not clogged, if the manostats 126, 128 are live, but indicate no clogging and the blade level detector 110 is energized and its blade 112 rotates.

When the exhauster means 14 operates, the putting into operation of the bush hammering means 34 is controlled by the opening of the electrovalve 66 controlling the supply of compressed air to the motors 60 by the pipe 64.

The triggering of the manostats 126, 128, the clogging detector of the electrostatic filter 26 and/or the locking of the blade 112 of the level detector 110 automatically bring about the closing of the valve 66 supplying the motors 60 with compressed air and then the closing of the valve 18 supplying compressed air to the exhauster means 14.

The unclogging or unblocking of the electrostatic filter 26 can only take place when the exhauster means 14 is stopped and the electrostatic filter is not energized. At this instant, the vibrator 124 can be put into operation in order to assist the dropping of the dust into the container 120. The treatment of the waste in the vessel 80 by using rows of sprinklers 90, 92 and tubes 106, 108 can take place at any time.

Thus, the remote cleaning installation described hereinbefore makes it possible to clean, by degradation, a surface located in a hostile medium, without human intervention other than that required for the maintenance of the installation, the waste and dust resulting from the surface degradation being recovered, treated and conditioned in a direct manner without requiring any complex, dangerous handling.

Obviously, the invention is not limited to the embodiment described in exemplified manner hereinbefore and covers all variants thereof.

Thus, the remotely controlled vehicle 32 can assume different forms and its remote control can be obtained in different ways without passing outside the scope of the invention. Moreover, the mounting of the bush hammering means on the said vehicle, which can simultaneously carry several such means, can be carried out in different ways, taking account of the orientation of the surface to be treated.

In addition, that part of the installation making it possible to recover and treat the waste can be subject to a number of variants. Thus, the two compartments 76, 78 can be replaced by two separate vessels. Conversely, the container 120 can be replaced by a third compartment integrated into the vessel 80.

We claim:

1. Installation for the remote cleaning by degradation of a surface located in a hostile medium, with recovery and treatment of the waste produced by the degradation, comprising:

a remotely controlled vehicle carrying at least one bush hammering means having at least one cutting edge with actuating means to give said at least one cutting edge a reciprocating movement, in order to operate on said surface within a closed space peripherally defined by a casing of the bush hammering means;

a pipe for collecting the waste produced by the cutting edges within the said closed space, connected to the casing and whose opposite end is connected to exhauster means;

at least on cyclone separator and filtering means placed successively in this order on the collecting pipe;

at least one tightly closed vessel for receiving and treating the waste collected by the cyclone separator and disconnectably connected below the latter and internally equipped with means for injecting treatment products and means for recovery of said products through filters.

2. Installation according to claim 1 comprising a single tightly closed vessel within which are formed a first, relatively large volume compartment below a first cyclone separator and a second, relatively small volume compartment connected below a second cyclone separator positioned downstream of the first cyclone separator on the collecting pipe, the first and second compartments being internally equipped with means for injecting treatment products and means for recovering the said products through filters.

3. Installation according to claim 2, wherein a blade-equipped level detector is placed in the first compartment.

4. Installation according to claim 1, wherein the filtering means comprise, downstream of the cyclone separator on the collecting pipe, an electrostatic filter having a hopper bottom, with means for tightly connecting to a container, which recovers the dust, following the electrical stoppage of the electrostatic filter.

5. Installation according to claim 4, wherein the electrostatic filter comprises an inlet cone in which are placed deflectors distributing the air flow in a homogeneous manner within the electrostatic filter.

6. Installation according to claim 4, wherein a vibrator is mounted on the hopper bottom of the electrostatic filter.

7. Installation according to claim 4, wherein the filtering means comprises, downstream of the electrostatic filter, at least one absolute filtering member.

8. Installation according to claim 7, wherein the electrostatic filter and the absolute filtering member are equipped with clogging detectors.

9. Installation according to claim 8, wherein a clogging signal emitted by any random clogging detector successively controls the automatic stopping of the actuating means of the cutting edge of the bush hammering means and the automatic stopping of the exhauster means.

10. Installation according to claim 1, wherein the actuating means for the cutting edges of the bush hammering means are of a pneumatic nature and are supplied by a compressed air supply pipe and discharge said compressed air to the outside of the bush hammering means by a discharge pipe having a cross-section at least twice that of the compressed air supply pipe.

11. Installation according to claim 1, wherein the bush hammering means is mounted on the vehicle by means of shock absorbers.

* * * * *

UNITED STATES PATENT AND TRADEMARK OFFICE

CERTIFICATE OF CORRECTION

PATENT NO. : 5,158,583

DATED : October 27, 1992

INVENTOR(S) : Francois Bodin and Jean Bonnant

It is certified that error appears in the above-identified patent and that said Letters Patent is hereby corrected as shown below:

Column 5, line 40, delete "install=d" and insert --installed--.

Column 6, line 46, delete "live" and insert --energized--; and line 47, delete "live" and insert --energized--.

Signed and Sealed this

Twenty-sixth Day of October, 1993

*Attest:*

*Attesting Officer*

BRUCE LEHMAN

*Commissioner of Patents and Trademarks*